US005494455A

United States Patent [19]

Shindoh et al.

[11] Patent Number: 5,494,455

[45] Date of Patent: Feb. 27, 1996

[54] PRESSURE TYPE CONNECTORS

[75] Inventors: Mikio Shindoh, Hachioji; Yohichi Kashiwa, Tokyo, both of Japan

[73] Assignee: The Whitaker Corporation, Wilmington, Del.

[21] Appl. No.: 441,568

[22] Filed: May 15, 1995

Related U.S. Application Data

[63] Continuation of Ser. No. 182,261, Jan. 14, 1994, abandoned.

[30] Foreign Application Priority Data

Feb. 18, 1993 [JP] Japan ..... 5-010994 U

[51] Int. Cl.[6] ..... H01R 4/24

[52] U.S. Cl. ..... 439/402; 439/404

[58] Field of Search ..... 439/394, 395, 439/399, 404, 410, 402

[56] References Cited

U.S. PATENT DOCUMENTS 3,836,944 9/1974 Lawson .
4,533,199 8/1985 Feldberg ..... 439/404
4,697,862 10/1987 Hasircoglu ..... 439/399
4,834,669 5/1989 Siemon et al. ..... 439/395
5,154,632 10/1992 Ijiri ..... 439/394

FOREIGN PATENT DOCUMENTS 980439 12/1975 Canada .

*Primary Examiner*—P. Austin Bradley
*Assistant Examiner*—Jeanne M. Elpel
*Attorney, Agent, or Firm*—Adrian J. LaRue

[57] ABSTRACT

Pressure-type connector 1 has a base 10 retaining a pressure contact 50 and a closure member 30 connected to the base 10 by means of a hinge 28. On a side surface of the base 10, locking bosses 18 are provided, and on the side surface of the closure member 30 locking rings 38 are located to be engaged with the locking bosses 18. At the outer end of the locking rings 38 a pair of protrusions 42 is disposed with a space between them being approximately equal to the width of the locking boss 18. When the closure member 30 is rotated toward the base 10, protrusions 42 which form the guiding device, slide along the side surfaces 24 of the locking bosses 18, thus preventing a skewed attitude relative the base 10. This arrangement makes it possible to provide for a better connection between electric wire 3 and the pressure contact 50.

6 Claims, 2 Drawing Sheets

Fig. 2
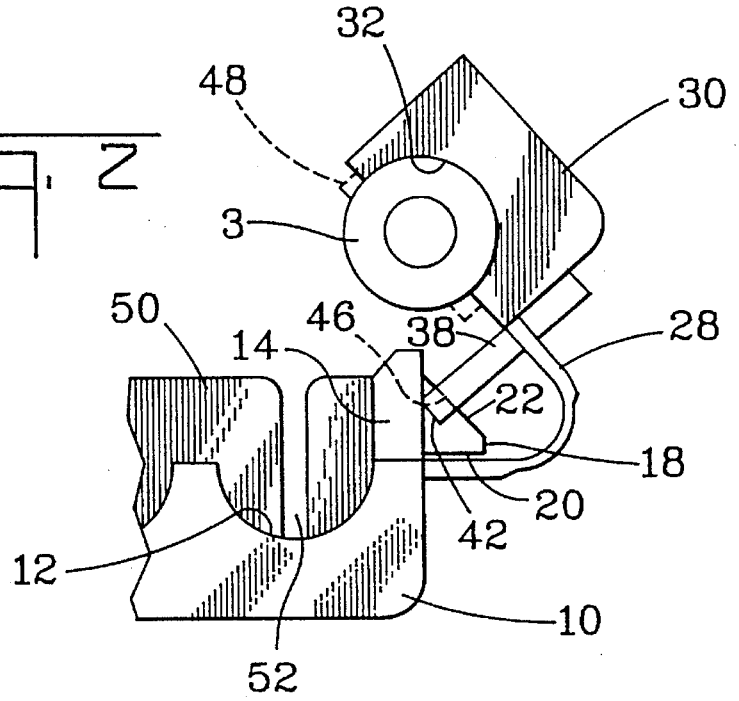
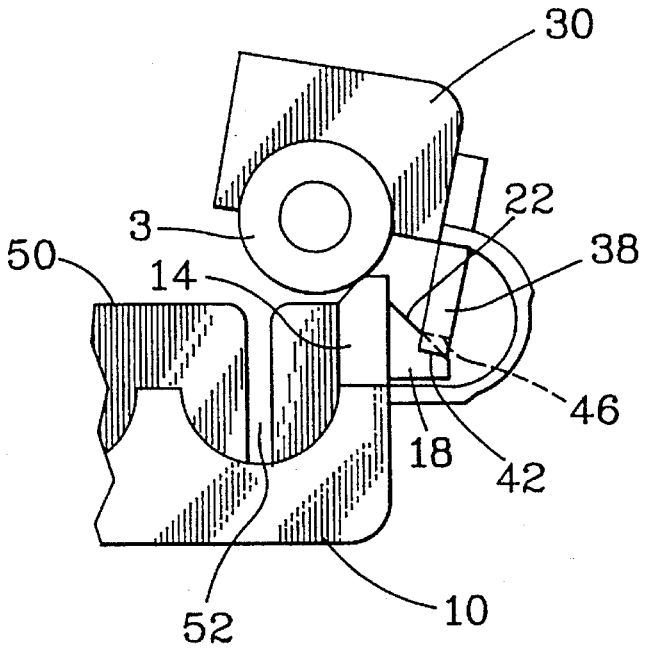
Fig. 3

PRESSURE TYPE CONNECTORS

This application is a continuation of application Ser. No. 08/182,261 filed Jan. 14, 1994, now abandoned.

FIELD OF THE INVENTION

This invention relates to pressure-type connectors in which connection of electric wires to pressure contacts mounted on a base is carried out by means of a closure made as an integral part of the base and is attached to it by a hinge.

BACKGROUND OF THE INVENTION

Pressure-type connectors which make it possible to carry out connection of electric wires to contacts without soldering or stripping the wires have gained wide recognition. One of such connectors is described in the Japanese Patent Application No. 79-10713. It is designed for connecting two parallel electric wires to each other. This connector 101, shown in FIG. 4, consists of a base 110 having a metal plate 150 with the pressure-connection slots, and closure members 130 made as an integral part of the base 110 and connected to it by means of hinge members 128 made in the form of a pair of flexible bands. Electric wires are placed in receptacle grooves 132 of the closure members 130, and when the closure members 130 are assembled with the base 110, locking bosses 118 on the outside surface of the base 110 become engaged with locking projections 138 of the closure members 130, thus accomplshing the connection between the electric wires and the metal plate 150.

However, since the hinge members 128 of this conventional connector 101 are made in the form of flexible bands, no means is provided to guide the closure members 130 for proper alignment. Therefore, there is always a danger that the metal plate 150 of the base 110 and the grooves 134 receiving the metal plate of the closure members 130 will be misaligned, resulting in a failure to form an appropriate pressure connection.

Therefore, the purpose of this invention is to offer a connector which will solve the above mentioned problems, that is a pressure-type connector of a simple design having means to guide the enclosure during its rotation, thus providing for a reliable connection obtained through pressure.

SUMMARY OF THE INVENTION

Pressure-type connectors according to this invention comprise a base having pressure contacts and of closure members with receptacle grooves for electric wires which are connected to the base by means of a hinge whereby the closure members can be brought to alignment with the base by rotating them via the hinge at which time locking rings on the closure members become engaged with locking bosses located at the sides of the base resulting in forming a connection between the electric wires inserted in the receptacle grooves and the pressure contacts, wherein a guide device is provided at the front edge of the locking bosses which fits around both sides of the locking bosses, thus controlling rotational movement of the closure members.

BRIEF DESCRIPTION OF THE DRAWINGS

An embodiment of the invention will now be described by way of example with reference to the accompanying drawings in which:

FIG. 2 shows the state of the rotation of a closure member of the connector depicted in FIG. 1.

FIG. 3 shows the same condition as shown in FIG. 2, but the rotation is in a more advanced stage.

DETAILED DESCRIPTION OF THE INVENTION

Figure 1:
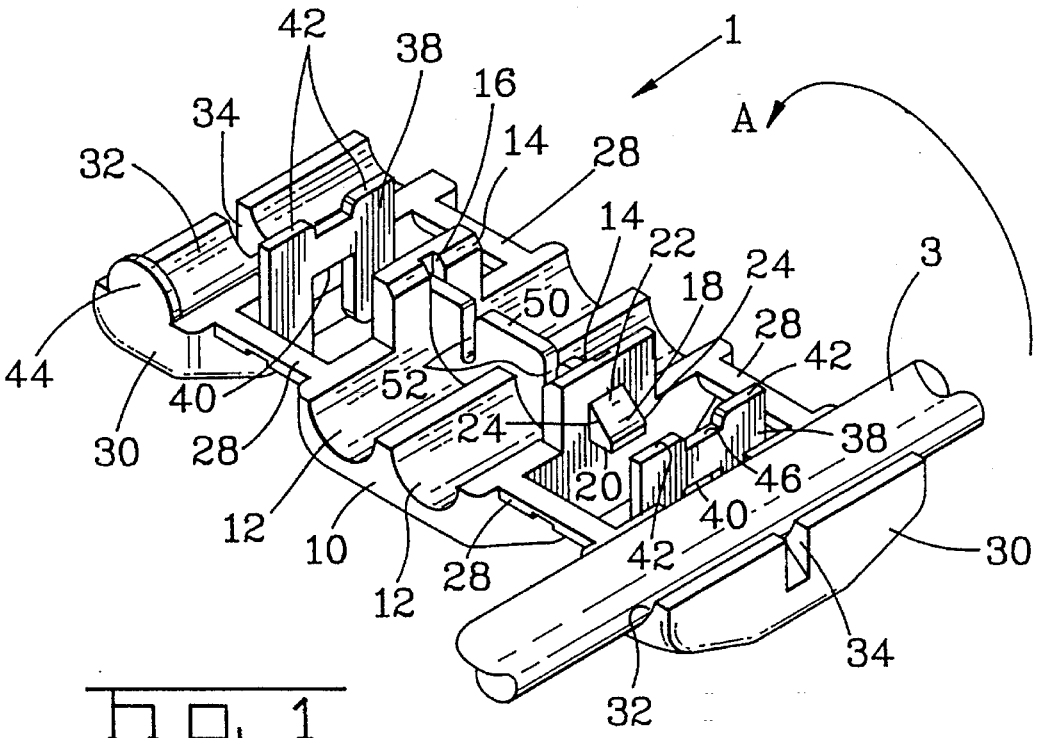
FIG. 1 is a perspective view of an embodiment of a pressure-type connector according to this invention.
Figure 4:
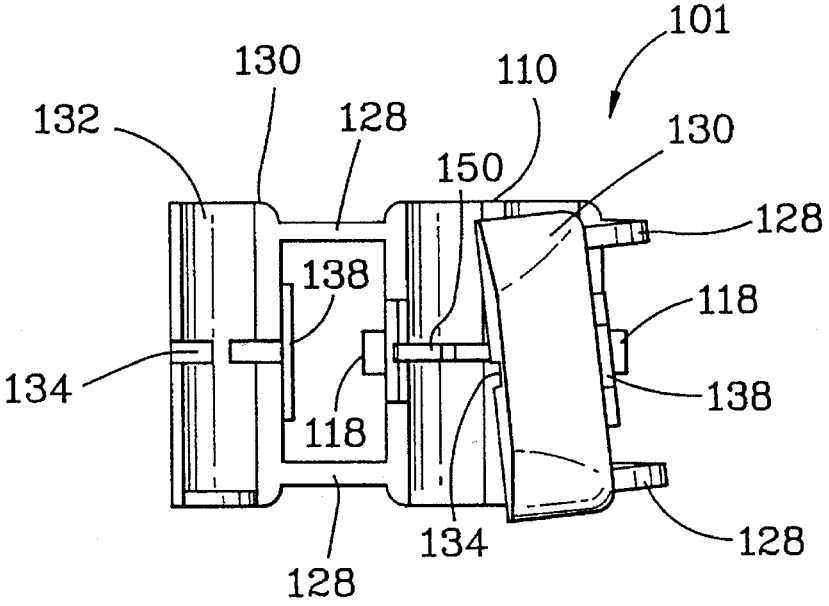
PRIOR ART Fig. 4
FIG. 4 is a top view of a conventional pressure-type connector illustrating its intrinsic problem.

In FIG. 1, the pressure-type connector 1 consists of a base 10 having pressure contact 50 and closure members 30 made as an integral part of base 10 and connected thereto by means of hinges 28. Base 10 has two parallel grooves 12 of a semicircular cross section intended for receiving electric wires 3. Pressure-type contact 50 is secured in the base 10 in such a manner that it extends across grooves 12. In the pressure contact 50, U-shaped slots 52 are provided in alignment with to the grooves 12. The ends of the pressure contact 50 fit into grooves 16 in projections 14 of the base 10 at certain intervals. On the external surface of the projections 14, locking bosses 18 are located which have a trapezoidal or triangular shape in cross-section (only one shape is shown in the drawing).

Semicircular grooves 32 for receiving the electric wires are made in each closure member 30, which together with the grooves 12 in the base 10 form circular receptacles for the electric wires. Approximately in the center of each closure member 30, a slot 34, in which a portion of the pressure contact is disposed, extends into the groove 32. At the side of each closure member 30, locking rings 38 are disposed between pairs of hinges 28. By shoulders 20 of the locking bosses 18 of the base 10 being disposed within the openings 40 of locking rings 38, the closure members 30 are fixed in the locked position to the base 10. At the outer end of the locking rings 38, a pair of protrusions 42 are located which have the same width as, or slightly wider than, the width of the locking bosses 18. The functions of these protrusions 42 will be described below. A stopper 44 determining the position of the front end of the electric wire 3 may be provided in one of the closure members 30. Using such a stopper 44, one can make the so-called T-connection of two electric wires.

FIG. 2 demonstrates what happens when closure member 30 is rotated in the direction of the arrow A shown in FIG. 1. Protrusions 42 of the locking ring 38 engage the external surface of the projection 14, and recess 46 between the protrusions 42 engages the slanted surface 22 of the locking boss 18. At this time, the locking boss 18 is positioned between the protrusions 42 within recess 46. When the closure 30 is rotated even farther, to a position shown in FIG. 3, the protrusions 42 become disengaged from the external surface of the arm 14, and the recess 46 slides along the slanted surface 22 of the locking boss 18. During this motion, the locking boss 18 is positioned between the protrusions 42 in other words, the pair of the protrusions 42 provides guiding action, along both sides 24 (FIG. 1) of the locking boss 18. Therefore, the closure member 30 rotates straight toward the base 10 and fits accurately thereon so that a portion of the pressure contact 50 fits within slot 34. FIG. 3 shows the position in which the base 10 and the closure member 30 are pressed together by means of pliers or another tool so that the shoulder 20 of the locking boss 18 is engaged within the opening 40 (FIG. 1) of the locking ring 38, and the electric wire 3 is forced into the slot 52 to complete connection with the pressure contact 50.

In addition, the closure member 30 may be equipped with a clamp 48 shown by a dotted lines in FIG. 2 for securing electric wire 3 therein. This clamp 48 prevents the electric wire 3 from falling out of the retaining groove 32 during rotation of the closure member 30, thus providing for a more reliable connection.

The effect of this invention realizes that a more reliable connection between the electric wire and the pressure contact can be achieved by adding a simple guiding device to a conventional pressure type connector which controls rotational motion of the closure member whereby the guiding device located at the outer end of the closure locking rings engages the locking bosses located on the external surface of the base.

We claim:

1. A pressure-type connector comprising a base having parallel wire-receiving grooves, a contact member secured in said base, said contact member having wire-connecting grooves therein; each of said wire-connecting grooves being in alignment with a respective one of said wire-receiving grooves closure members having wire-carrying grooves;

hinges hingedly connecting said closure members to said base so that said closure members can be moved from a first position in which electric wires are disposed in said wire-carrying grooves and a second position at which said closure members are superimposed onto said base with the electric wires being disposed in said wire-connecting grooves interconnecting the electric wires and in said wire-receiving grooves;

guide devices on said base and said closure members for guiding said closure members to said second position; and locking members on said base and said closure members locking said closure members at said second position.

2. A pressure-type connector as claimed in claim 1, wherein said guide devices comprise wedge-shaped members and ring members having spaced protrusions at outer ends thereof defining a recess.

3. A pressure-type connector as claimed in claim 1, wherein said locking members comprise wedge-shaped members and locking ring members.

4. A pressure-type connector as claimed in claim 1, wherein said guide devices comprise wedge-shaped members on said base and ring-shaped members having spaced protrusions at outer ends thereof on said closure members, and said locking members include said ring-shaped members that receive said wedge-shaped members therein.

5. An electrical connector for interconnecting electrical wires comprising a base having a pair of parallel wire-receiving grooves, a common contact member having wire-connecting grooves and itersecting the wire-receiving grooves such that each of the wire-receiving grooves is in alignment with a respective one of the wire-connecting grooves, a pair of closure members each having a wire-carrying groove in which an electrical wire is to be disposed, hinge members connecting the closure members to said base enabling the closure members with an electrical wire in each wire-carrying groove to be moved from a first position to a second position superimposed onto said base with the electrical wires being disposed in said wire-connecting grooves interconnecting the electrical wires and in said wire-receiving grooves, locking bosses on opposing sides of said base and having slanted surfaces, locking rings provided by said closure members having recesses in outer edges thereof so that said recesses engage said slanted surfaces of said locking bosses as said closure members are moved from the first position to the second position thereby guiding the closure members during such movement of the closure members until the closure members are superimposed onto said base whereby the locking rings fully engage the locking bosses thereby locking the closure members onto said base.

6. An electrical connector as claimed inn claim 5, wherein one of said closure members has a stopper at the end of the wire-carrying groove thereof against which an end of one of the electrical wire engages when positioned in the wire-carrying grove.

* * * * *